US006442840B2

(12) United States Patent
Zucker

(10) Patent No.: US 6,442,840 B2
(45) Date of Patent: Sep. 3, 2002

(54) ELECTRIC RAZOR WITH DIRECT CONTACT ROLLER-MOUNTED BLADES

(75) Inventor: Shlomo Zucker, Michmoret (IL)

(73) Assignee: Wheel Technology Ltd., Grand Cayman (KY)

( * ) Notice: Subject to any disclaimer, the term of this patent is extended or adjusted under 35 U.S.C. 154(b) by 0 days.

(21) Appl. No.: 09/824,044

(22) Filed: Apr. 3, 2001

Related U.S. Application Data

(63) Continuation of application No. 09/009,410, filed on Jan. 20, 1998, now abandoned.

(51) Int. Cl.[7] ..... B26B 19/14

(52) U.S. Cl. ..... 30/42; 30/34.2; 30/43.6; 30/50

(58) Field of Search ..... 30/43.6, 50, 43.4, 30/43.5, 34.2, 42

(56) References Cited

U.S. PATENT DOCUMENTS

| | | | | | |
|---|---|---|---|---|---|
| 1,226,614 | A | * | 5/1917 | Hiskey | 30/50 X |
| 1,519,504 | A | * | 12/1924 | Pando | 30/43.6 X |
| 2,265,281 | A | * | 12/1941 | Hale | 30/34.2 X |
| 2,423,595 | A | * | 7/1947 | Hall | 30/43.6 X |
| 3,089,236 | A | * | 5/1963 | Galvao | 30/43.6 X |
| 4,031,618 | A | * | 6/1977 | Mansfield | 30/43.6 X |
| 5,201,781 | A | * | 4/1993 | Jestadt et al. | 30/43.92 |

FOREIGN PATENT DOCUMENTS

| | | | | |
|---|---|---|---|---|
| FR | 667287 | * | 10/1929 | 30/43.6 |
| FR | 1080550 | * | 12/1954 | 30/43.6 |
| GB | 10700 | * | 12/1909 | 30/43.6 |
| GB | 7435 | * | 3/1911 | 30/34.6 |
| GB | 528510 | * | 10/1940 | 30/43.6 |

* cited by examiner

*Primary Examiner*—Charles Goodman
(74) *Attorney, Agent, or Firm*—Mark M. Friedman

(57) ABSTRACT

A razor for shaving hair from the skin of a user includes a rotating blade assembly connected so as to be rotated by a drive mechanism. The blade assembly includes a generally cylindrical roller rotatably mounted along its longitudinal axis, at least one blade mounted on, and extending along a major part of, the roller, and a guide element associated with each blade. The blade and the guide element are configured to form a safety blade such that, when the blade assembly rotates in direct contact with the skin, the at least one blade shaves hair from the skin without cutting the skin. Preferably, the razor includes two similar blade assemblies rotated by the drive mechanism in opposing directions so as to apply stretching tension to the skin of the user. Also described are a number of safety blade configurations relevant to both manual and power driven exposed-blade razors.

13 Claims, 11 Drawing Sheets

ELECTRIC RAZOR WITH DIRECT CONTACT ROLLER-MOUNTED BLADES

This is a Continuation of U.S. Ser. No. 09/009,410 filed Jan. 20, 1998 now abandoned.

FIELD AND BACKGROUND OF THE INVENTION

The present invention relates to electric razors and, in particular, it concerns an electric razor with roller-mounted blades which move in direct contact with the skin of a user.

The extensive range of known devices for shaving hair can be broadly classified into two types: manual razors and electric razors. Manual razors generally employ a blade assembly fixed or pivotally attached to a handle. After application of foam or other lubricating material to the skin, the razor is manually manipulated so as to move the blade assembly across the skin, the blades coming into direct contact with the skin.

Electric razors, on the other hand, employ a motor to generate a relatively high speed reciprocating or rotating cutting motion. To protect the skin, the cutting action typically occurs at the rear side of a thin "foil" which is formed as a cover with holes through which the hairs extend.

Each type of razor has particular advantages and disadvantages. The direct skin contact of manual shavers provides a closeness of shave not yet achieved by any electric shaver. However, to achieve this closeness of shave, a number of repeated strokes of the razor are required over each part of the skin. Furthermore, for the closest possible shave, a final repetition is made in a direction opposing the direction of hair growth. This renders the procedure of shaving relatively slow.

Electric razors, on the other hand, benefit from high-speed repetition of the shaving action wherever the razor is currently passing. As a result, the best shave achievable with a given cutting configuration should, in principle, be achieved is a single pass over the skin. In practice, however, the foil structure does not usually trap all of the hairs in a cutting position during the first pass. Thus, a number of repetitive strokes are also typically required with an electric razor.

A further shortcoming of both types of razor is the need for the use of two hands during shaving. In order to bring the hairs into an efficient cutting position, the hairs must first be erected, typically by stretching of the skin. This is normally done by manually stretching the skin with the hand which is not currently holding the razor, thereby turning shaving into a two-hand operation.

There is therefore a need for an electric razor which combines highspeed repetitive shaving action with the closeness of a direct-contact manual razor. It would also be advantageous to provide an electric razor which employs two cutter assemblies with opposing movement so as to inherently cut both with and against the direction of hair growth, and which is effective to stretch the skin as an inherent part of the cutting motion.

SUMMARY OF THE INVENTION

The present invention is an electric razor with roller-mounted blades which move in direct contact with the skin of a user.

According to the teachings of the present invention there is provided, a razor for shaving hair from the skin of a user, the razor comprising: (a) a drive mechanism; and (b) a rotating blade assembly connected so as to be rotated by the drive mechanism, the blade assembly including: (i) a generally cylindrical roller rotatably mounted along its longitudinal axis, (ii) at least one blade mounted on, and extending along a major part of, the roller, and (iii) a guide element associated with each blade, wherein the at least one blade and the guide element are configured to form a safety blade such that, when the blade assembly rotates in direct contact with the skin, the at least one blade is operative to shave hair from the skin without cutting the skin.

According to a further feature of the present invention, the blade and the guide element are implemented as part of a blade cartridge, the blade cartridge being attached to the roller such that at least a part of the blade cartridge is displaceable so as to vary a distance of the blade from the longitudinal axis.

According to a further feature of the present invention, the blade cartridge is pivotally connected to the roller, the blade cartridge being biased to a raised position.

According to a further feature of the present invention, the blade cartridge is connected to the roller in a double-hinge manner, the blade cartridge being biased to a raised position.

According to a further feature of the present invention, the blade cartridge is a double-blade cartridge.

According to a further feature of the present invention, there is also provided a pneumatic cleaning mechanism mounted within the rotating blade assembly, the pneumatic cleaning mechanism being configured so as to direct a flow of air adjacent to the blade.

According to a further feature of the present invention, the pneumatic cleaning mechanism is mechanically linked so as to be actuated by the displacement of the blade cartridge.

According to a further feature of the present invention, the guide element is implemented as a spacer adjacent to, and extending parallel to the length of, the blade, the spacer providing projections spaced along the length of the blade, the projections projecting outwards to above a cutting plane so as to prevent the blade from cutting the skin.

According to a further feature of the present invention, the spacer is displaceable relative to the blade, the spacer being biased from a rear guide position towards a forward position such that the spacer tends to eject any material accumulated in front of the blade during shaving, the spacer becoming depressed to the rear guide position on contact with the skin.

According to a further feature of the present invention, the rotating blade assembly is referred to as the first rotating blade assembly, the razor further comprising a second rotating blade assembly similar to the first rotating blade assembly, the first and second rotating blade assemblies being connected so as to be rotated by the drive mechanism in opposing directions.

According to a further feature of the present invention, the first and second rotating blade assemblies rotate so as to apply stretching tension to the skin of the user.

According to a further feature of the present invention, there is also provided an oscillator mechanism configured so as to produce a reciprocating movement of the blade parallel to the longitudinal axis during rotation of the blade assembly.

According to a further feature of the present invention, the oscillator mechanism is switchable between an operative state in which the oscillator mechanism is active to generate the reciprocating movement of the blade and an inoperative state in which the oscillator mechanism is deactivated.

There is also provided according to the teachings of the present invention, a razor for cutting hair from the skin of a user, the razor comprising a safety blade assembly, the safety blade assembly including: (a) at least one elongated blade having a cutting edge, a rear edge and a lower surface; and (b) a spacer adjacent to the lower surface and extending parallel to the length of the blade, wherein the spacer provides projections spaced along the length of the blade, the projections projecting outwards to above a cutting plane of the blade so as to prevent the blade from cutting the skin.

According to a further feature of the present invention, the spacer is displaceably mounted relative to the blade, the blade assembly further comprising a spring element deployed so as to bias the spacer from a rear guide position towards a forward position such that the spacer tends to eject any material accumulated in front of the blade during shaving, the spacer becoming depressed to the rear guide position on contact with the skin.

There is also provided according to the teachings of the present invention a razor for cutting hair from the skin of a user, the razor comprising a safety blade assembly, the safety blade assembly including: (a) at least one blade having an elongated cutting edge configured for cutting in a cutting direction, a virtual plane passing through the cutting edge and containing the cutting direction being referred to as a cutting plane; and (b) a plurality of skin guide ridges located ahead of, and substantially adjacent to, the cutting edge, the skin guide ridges being deployed above the cutting plane and spaced along the cutting edge so as to prevent the blade from cutting the skin.

According to a further feature of the present invention, the safety blade assembly further includes a lead surface located ahead of the cutting edge, at least a part of the lead surface nearest to the cutting edge being substantially coplanar with the cutting plane, the skin guide ridges being implemented as ridges projecting from the lead surface.

According to an alternative feature of the present invention, the safety blade assembly includes a lead surface located ahead of the cutting edge, at least a part of the lead surface being substantially parallel to, but above, the cutting plane, a part of the lead surface nearest to the cutting edge being formed with a plurality of recesses configured to allow the skin of the user to approach the cutting edge, the skin guide ridges being implemented as continuations of the lead surface between the plurality of recesses.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an electric razor with roller-mounted blades which move in direct contact with the skin of a user.

The principles and operation of razors according to the present invention may be better understood with reference to the drawings and the accompanying description.

Figure 1:
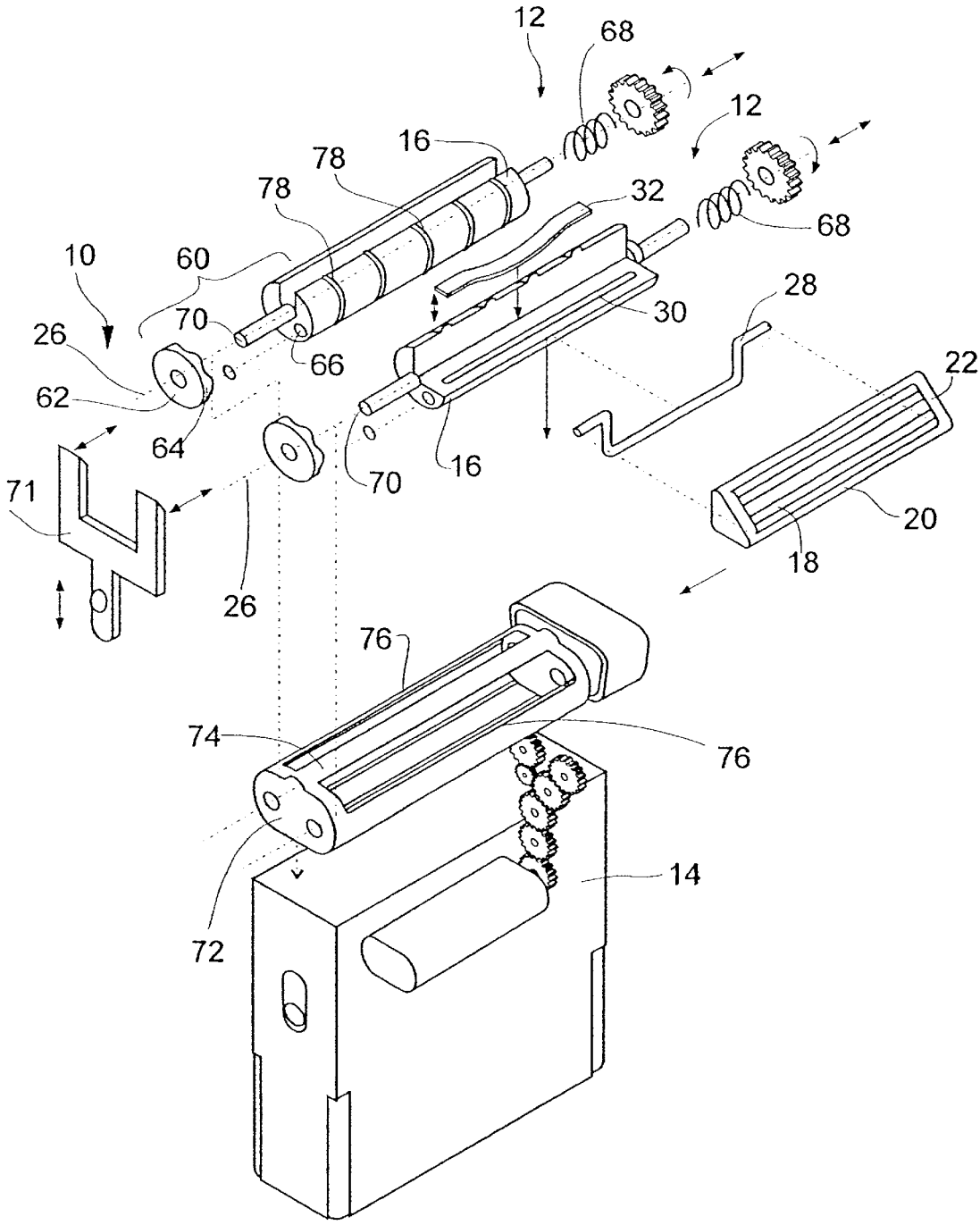
FIG. 1 is a schematic, exploded, isometric view of an electric razor, constructed and operative according to the teachings of the present invention, having a pair of rotating blade assemblies.

Referring now to the drawings, FIG. 1 shows a razor, generally designated 10, constructed and operative according to the teachings of the present invention, for shaving hair from the skin of a user.

Generally speaking, razor 10 has at least one rotating blade assembly 12 connected so as to be rotated by a drive mechanism 14. Each blade assembly 12 includes a generally cylindrical roller 16 rotatably mounted along its longitudinal axis. At least one blade 18 is mounted on roller 16, extending along a major part the roller's length. Blade 18, together with an associated guide element 20, are configured to form a safety blade structure.

The phrase "safety blade" as used herein in the specification and claims denotes a cutting geometry in which a leading guide element positioned in front of the blade defines the angle and position of the blade relative to the skin surface such that it can be drawn across in direct contact with a flat area of the skin without cutting into the skin. As with any exposed blade device, local irregularities of the skin surface may lead to small cuts where the skin projects outwards. However, the safety blade structure ensures that any such cuts are limited to minimal depth.

It will be appreciated that the combination of a safety blade structure in a rotating blade assembly provides a unique synergy. The safety blade structure allows the razor to operate in direct contact with the skin, thereby achieving all the advantages of manual shaving. At the same time, the powered rotation of the blade assembly ensures that the blade passes over the skin surface multiple times. Thus, a close shave can be achieved by drawing razor 10 once across an area of skin without repetitive manual movements of the razor.

Blade 18 is described as extending along a major part the length of roller 16. Although, all the examples of blade structures described below are linear blades extending parallel to the axis of rotation of roller 16, it should be appreciated that the present invention in its broadest form is not limited to such a structure. For example, blade 18 could alternatively have a helical structure arranged around the surface of roller 16 so that it extends along a major part of the roller's length. Preferably, blade 18 extends along substantially the entire length of the roller.

Turning now to the features of razor 10 in more detail, razor 10 preferably includes two rotating blade assemblies 12, as shown, connected to drive mechanism 14 so as to be rotated in opposing directions. Advantageously, the two rotating blade assemblies 12 are mounted so as to be roughly parallel and co-extensive, and are driven in opposite directions. This ensures that, in any given position, one of the blade assemblies will be cutting against the direction of growth of the hair. Most preferably, the two blade assemblies rotate in directions as indicated in FIG. 1 by curved arrows such that the surfaces in contact with the skin are effectively moving outwards away from each other. This applies diverging stretching tension to the skin of the user, thereby bringing the hairs to an upright position to facilitate efficient cutting.

In the embodiment illustrated here, blade 18 and guide element 20 are implemented as part of a blade cartridge 22. Blade cartridge 22 is generally similar to a conventional safety razor cartridge of single-blade, or preferably double-blade, form. It may be advantageous to modify the cartridge somewhat from a conventional cartridge in that the top profile is rounded to conform to the outer contour of roller 16. Other optional features of the blade cartridge will be described below with reference to FIGS. 3–5.

Cartridge 22 is mounted within a corresponding cut-out 24 within roller 16, preferably in such a manner that at least a part of the blade cartridge is displaceable so as to vary a distance of the cutting edge of blade 18 from the longitudinal axis 26 of roller 16. By way of example, the cartridge illustrated in FIG. 1 is pivotally mounted on the ends of a projecting bracket 28 which engages within a slot 30 on one face of cut-out 24. A spring element 32 biases blade cartridge 22 to a raised position.

Figure 2A:
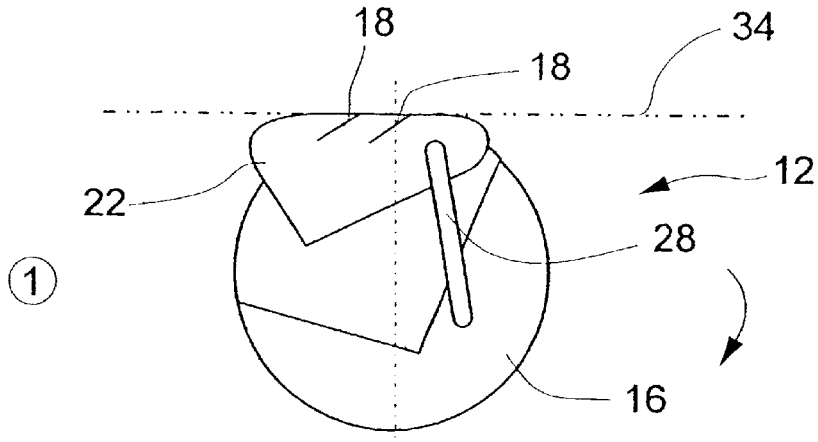
FIGS. 2A–2C are schematic side views illustrating the movement of a blade cartridge during successive stages of rotation of one of the rotating blade assemblies of FIG. 1.
Figure 2B:
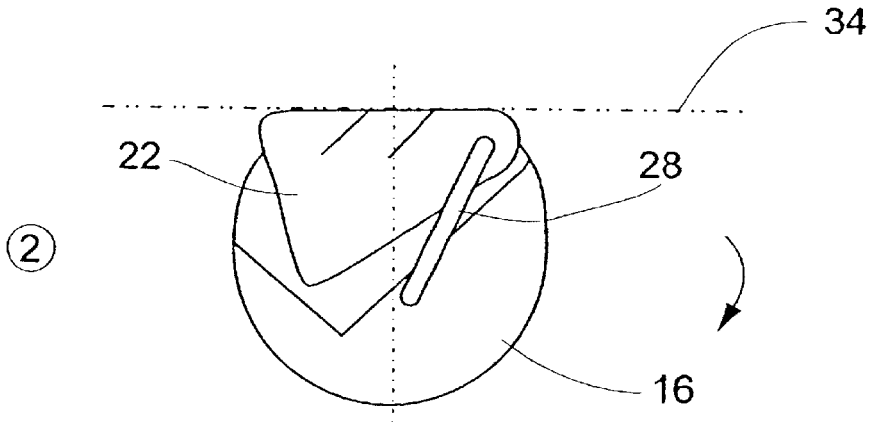
Figure 2C:
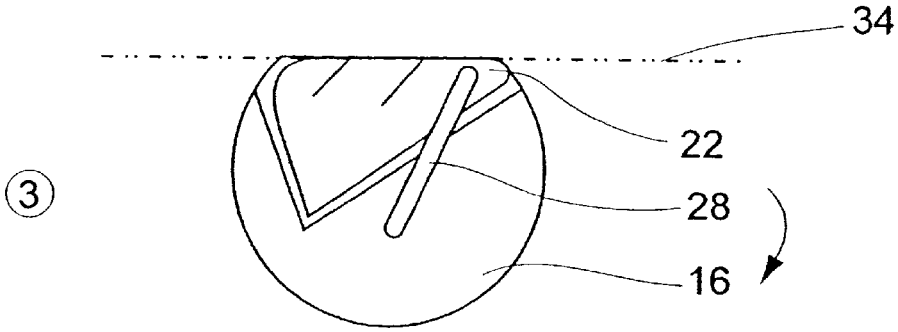

The significance of this structure will become clearer from FIGS. 2A–2C which show schematically the position of the cartridge 22 relative to roller 16 as blade assembly 12 rotates in contact with the skin 34 of a user. FIG. 2A shows cartridge 22 in its raised position at the moment when the blades first make contact with the skin. As roller 16 continues to turn through the position shown in FIG. 2B to that of FIG. 2C, pressure of the skin against cartridge 22 compresses the spring element so as to pivot the cartridge inwards into cut-out 24. If one examines the point of contact of the blades with the skin in successive positions, it will be clear that the blades have a significant length of substantially linear travel in contact with the skin during each revolution of blade assembly 12. This results in a much more efficient cutting movement than would be possible with a fixed blade traveling in a strictly circular path. Typically, for a compact roller 16 of diameter between about 10 and about 20 mm, this design can increase the length of effective cutting movement in contact with the skin to several millimeters or more, in contrast to a contact path of less than about one millimeter for a circular path.

Parenthetically, it should be noted that the motion of blade cartridge 22 is pivotal about an axis near guide element 20. As a result, the movement of blades 18 is not "radial" with respect to longitudinal axis 26. All that is required is that the distance of the cutting edge of blade 18 from the longitudinal axis 26 of roller 16 varies in a manner such as to extend the travel of the blade in contact with the skin relative to a circular path.

Figure 3:
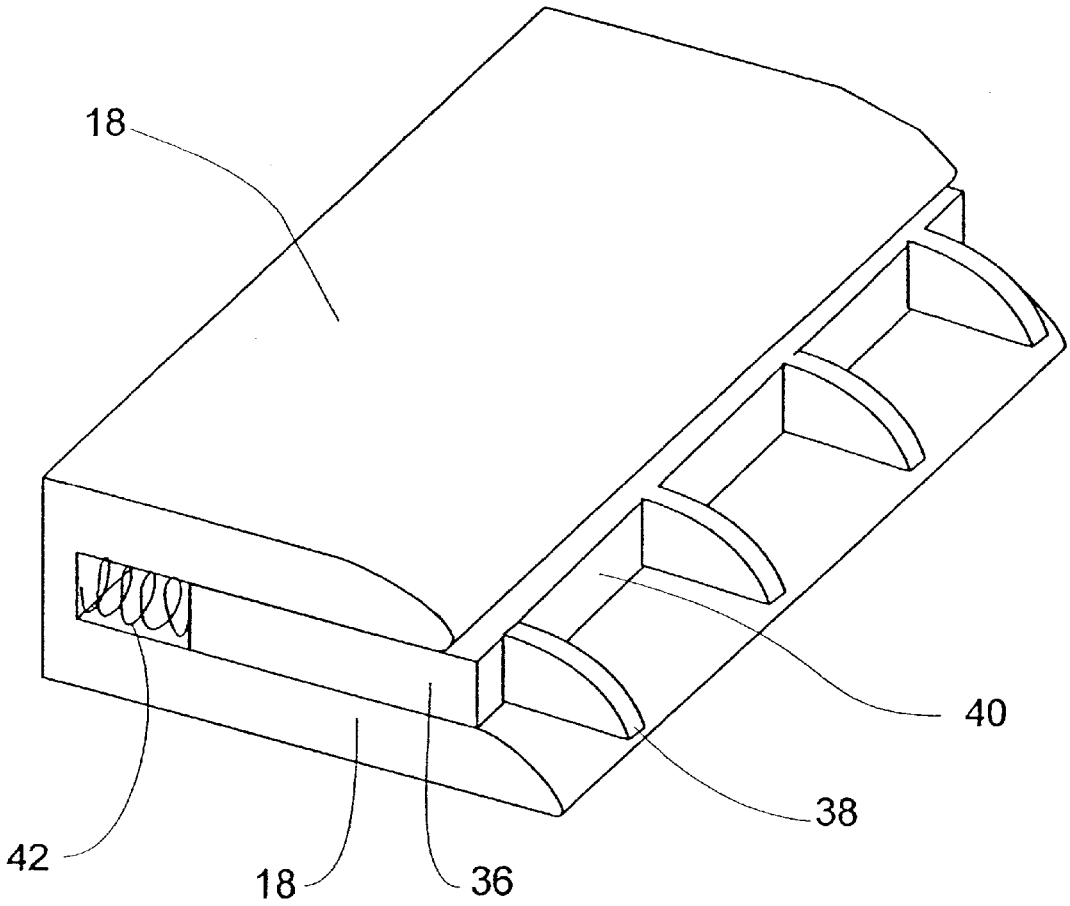
FIG. 3 is a schematic isometric view of a configuration of blades and spacer elements for use in the blade cartridge of FIGS. 2A–2C.

Referring now to FIGS. 3 and 4, it is a particular feature of certain preferred embodiments of the present invention that guide element 20 is implemented as a spacer 36 adjacent to, and extending parallel to the length of, blade 18. Spacer 36 has projections 38 spaced along the length of blade 18 and projecting outwards to above its cutting plane so as to prevent the blade following immediately behind the projections from cutting the skin. The term "cutting plane" as used herein in the description and claims refers to a plane defined by the upper face of the blade adjacent to the cutting edge, i.e., the grinding angle of the cutting edge. This plane corresponds to the plane swept by the cutting edge of the blade as it advances in its instantaneous cutting direction. This plane so defined normally includes also the surface of guide element 20. In cases in which the safety blade configuration is provided by localized projections spaced along the blade, as will be described below, this condition is not essential. However, even in the latter case, it is preferable that the general level of the surface ahead of the blade does in fact lie in the cutting plane.

Figure 4A:
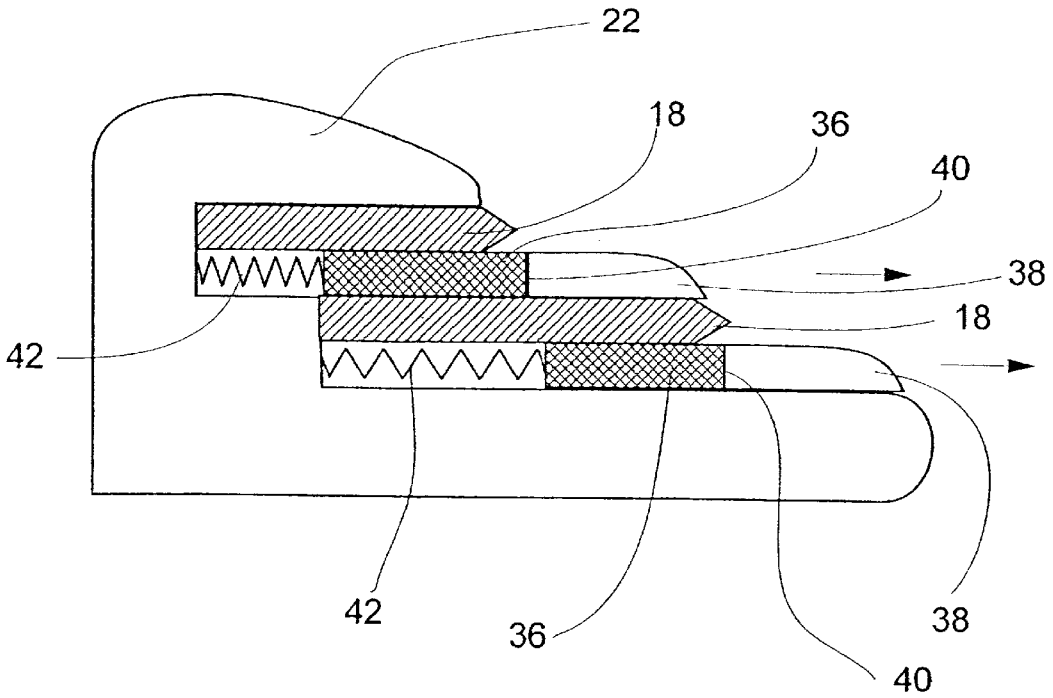
FIGS. 4A and 4B are cross-sectional views through the blade cartridge of FIGS. 2A–2C illustrating the operation of the spacer elements of FIG. 3.
Figure 4B:
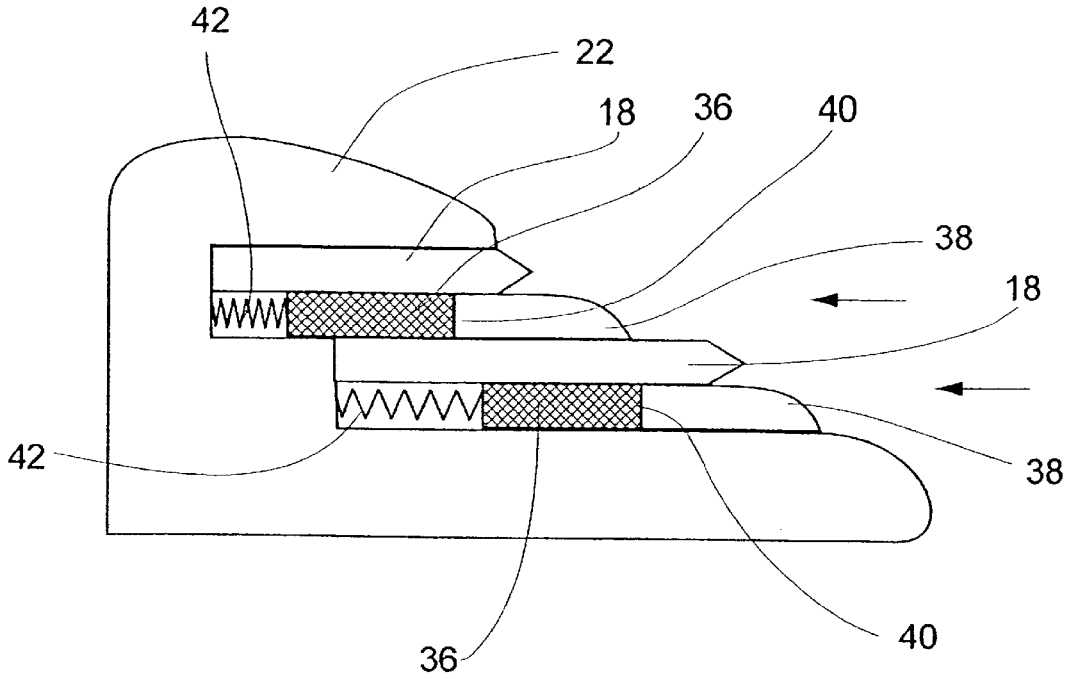

Preferably, spacer 36 is displaceable relative to the cutting edge of the blade between a forward position as shown in FIG. 4A and a rear position as shown in FIG. 4B. In the rear position, projections 38 serve to provide the safety blade configuration mentioned above. In the forward position, a leading edge 40 of the main part of spacer 36 extends forward at least as far as the cutting edge of the blade. In this case, spacer 36 is biased by at least one ejector spring 42 from the rear guide position towards the forward position. On contact with the skin, ejector spring 42 is compressed so that spacer 36 retracts to the rear guide position. In the absence of frontal pressure on the spacer, ejector spring 36 pushes spacer 36 forward, tending to eject hair, dirt and any other material which has accumulated in front of the blade during shaving.

Clearly, spacer 36 may be used with either a single blade, or a double blade as shown here. In the latter case, the rear guide position and forward position are each defined relative to the position of the blade following immediately behind the spacer.

Furthermore, it should be appreciated that, although described in the context of the roller configuration of the present invention, spacer 36 may readily be used to advantage in other contexts including, but not limited to, in an otherwise conventional manual shaving device.

Figure 5:
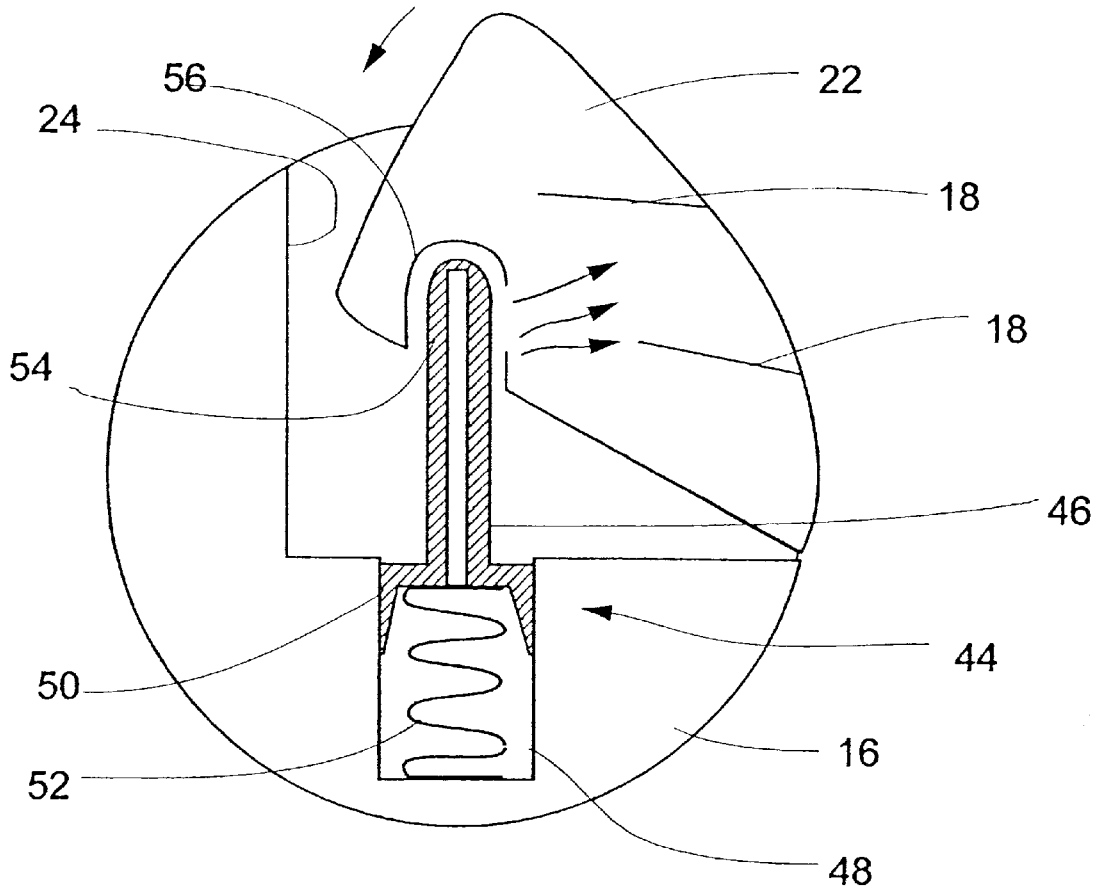
FIG. 5 is a schematic cross-sectional view through the rotating blade assembly of FIGS. 2A–2C illustrating a pneumatic cleaning system for the blade cartridge.
Figure 6:
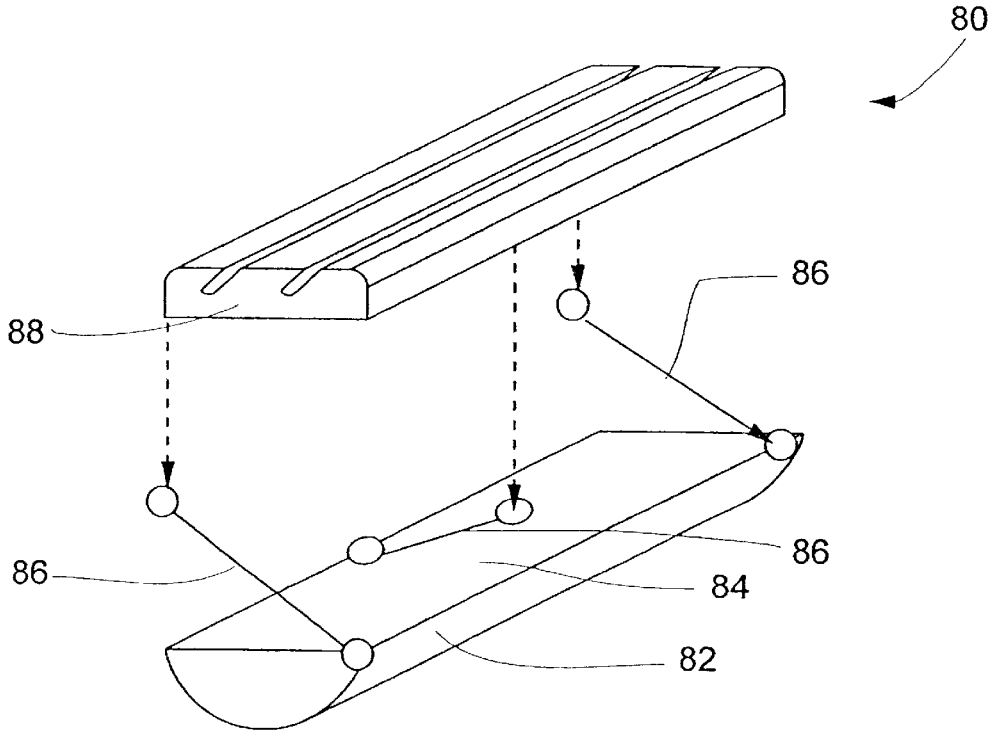
FIG. 6 is a schematic exploded isometric view of a variant of the rotating blade assembly of FIGS. 2A–2C showing an alternative, double-hinged form of attachment of the blade cartridge.

Turning now to FIG. 5, this shows a further feature of certain preferred embodiments of the present invention in which a pneumatic cleaning mechanism 44 is mounted within rotating blade assembly 12. Pneumatic cleaning mechanism 44 is configured so as to direct a flow of air adjacent to one or more blades so as to tend to eject accumulated hair, dirt or other foreign matter. Preferably, pneumatic cleaning mechanism 44 is mechanically linked so as to be actuated by the displacement of blade cartridge 22 described above. Optionally, a number of similar pneumatic cleaning mechanisms 44 may be spaced along the length of the blade assembly.

In the specific example illustrated, pneumatic cleaning mechanism 44 includes a piston 46 mounted within a cylinder 48 formed in the wall of cut-out 24. The seal 50 of piston 46, biased by a spring 52 to a raised position as shown, is formed as a one-way valve so as to only allow intake into cylinder 48. The outlet is through a nozzle 54 which sits within a socket 56 in cartridge 22 adjacent to the rear edge of blades 18.

Operation of pneumatic cleaning mechanism 44 is as follows. Turning of blade assembly 12 as described above with reference to FIGS. 2A–2C causes cartridge 22 to be pressed inwards. This movement forces piston 46 downwards into cylinder 48 against spring 52, thereby forcing a stream of air out through nozzle 54. Socket 56 is configured such that a major part of the stream of air is directed forwards across the surfaces of the blades, against the direction of cutting, thereby helping to remove accumulated foreign matter. Once inward pressure on the cartridge is removed, i.e., the cartridge is no longer in contact with the skin, spring 52 returns the piston and hence the cartridge to its raised position, simultaneously drawing in air past seal 50. Thus, spring element 32 can typically be omitted when pneumatic cleaning mechanism 44 is used.

Referring now back to FIG. 1, certain preferred embodiments of the present invention include an oscillator mechanism 60 configured so as to produce a reciprocating movement of blade 18 parallel to longitudinal axis 26 while blade assembly 12 rotates. This turns the cutting movement into a more efficient "slicing" action. Preferably, oscillator mechanism 60 is switchable between an operative state in which it is active to generate the reciprocating movement of the blade and an inoperative state in which the oscillator mechanism is deactivated.

In the particular implementation shown here, oscillator mechanism 60 includes a profiled guide ring 62 mounted coaxially with roller 16 at one end. Guide ring 62 has at least one projecting undulation 64 against which a pin 66 protruding from the end of the roller abuts. A helical spring 68 at the other end of roller 16 urges the roller axially against guide ring 62. The combined structure of blade assembly 12 and oscillator mechanism 60 is mounted on an axle 70 within a housing 72.

Guide ring 62 is fixed to one side of housing 72 so that it cannot turn. As a result, when roller 16 rotates, movement of pin 66 across projecting undulation 64 pushes roller 16 axially against helical spring 68 and then allows it to return under bias of the spring. This axial oscillation corresponds to the aforementioned reciprocating movement of blade 18 parallel to longitudinal axis 26.

It will be apparent that this axial movement is only of significant value during the part of the revolution of the blade assembly when the blades are in contact with the skin. It is therefore sufficient to provide guide ring 62 with a single undulation 64 appropriately positioned relative to pin 66. In this context, it should be noted that the term "oscillation" is used herein to refer to any cyclic movement which includes a displacement in a first direction followed by a displacement in the opposite direction. The term does not necessarily imply either continuous or center-symmetric movement.

As mentioned earlier, oscillator mechanism 60 may be switchable to an inoperative state. This is simply achieved by providing a switch mechanism 71 mounted on an end of housing 72 which, in one position, pushes axles 70 inwards against springs 68 so as to remove pin 66 from contact with guide ring 62.

Turning briefly to the features of housing 72 itself, it is important that the upper openings of housing 72 provide sufficient space for cartridge 22 to reach the raised state of FIG. 2A before it comes in contact with the skin. At the same time, housing 72 preferably provides a number of fixed surface, in this case, a central partition 74 and two outer edges 76. These serve as stationary stops so that, if razor 10 is held at an angle with only one blade assembly in contact with the skin, the fixed surfaces tend to prevent the razor from advancing across the surface of the skin.

Finally with regard to FIG. 1, rollers 16 are preferably made from a material which provides relatively low frictional forces on the skin so as to generate the desired tension without causing irritation through excessive rubbing. Optionally, the outer surface of roller 16 features a number of circumferential projecting ridges 78 or other textured features.

Typically, roller 16 has a diameter of about 1 cm and a length of about 4 cm. The rotating blade assembly preferably generates at least a number of blade strokes against the skin per second, and preferably between about 10 and about 20.

Turning now to FIGS. 6 and 7A–7C, an alternative implementation of blade assembly, generally designated 80, employing a double-hinged form of attachment of the blade cartridge. Specifically, blade assembly 80 has a roller 82 with a substantially flat cut-out 84. Attached at or near opposite edges of cut-out 84 are a number of double-hinge elements 86. Each double-hinge element 86 is hingingly connected at or near the opposite edge of a blade cartridge 88 to form an alternating two-way hinge. The words "alternating twoway hinge" are used here to refer to a double-hinge which can pivot from a starting position about either of two parallel axes, and in which pivoting around one of the axes locks the other axis. This type of hinge is equivalent to the hinge structure of the well known "flip-flop" children's toy. Here too, blade cartridge 88 is biased to a raised position by a spring element 90. By positioning the spring asymmetrically closer to one pivotal axis, the spring can be configured to tend to return blade cartridge 88 uniquely to one of the two possible raised positions.

Figures 7A, 7B, 7C:
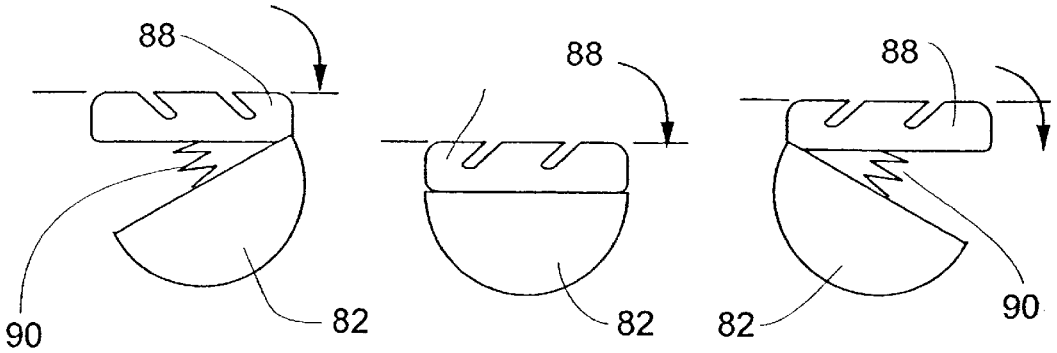
FIGS. 7A–7C are schematic side views similar to FIGS. 2A–2C, respectively, illustrating the movement of the double-hinged blade cartridge of FIG. 6.

FIGS. 7A–7C show the movement of blade cartridge 88 relative to roller 82 as blade assembly 80 rotates in contact with skin 34. As described above in the context of blade assembly 12, blade cartridge 88 travels across the skin as it is depressed from the initial raised position of FIG. 7A to the lower position of FIG. 7B. In this case, however, blade cartridge 88 travels an additional movement in contact with the skin as spring 90 raises the blade cartridge 88 to the second raised position of FIG. 7C. Once the blade assembly turns further to free the blade cartridge from contact with the skin, the asymmetric spring element tends to flick the blade cartridge back to its initial raised position.

Figure 8:
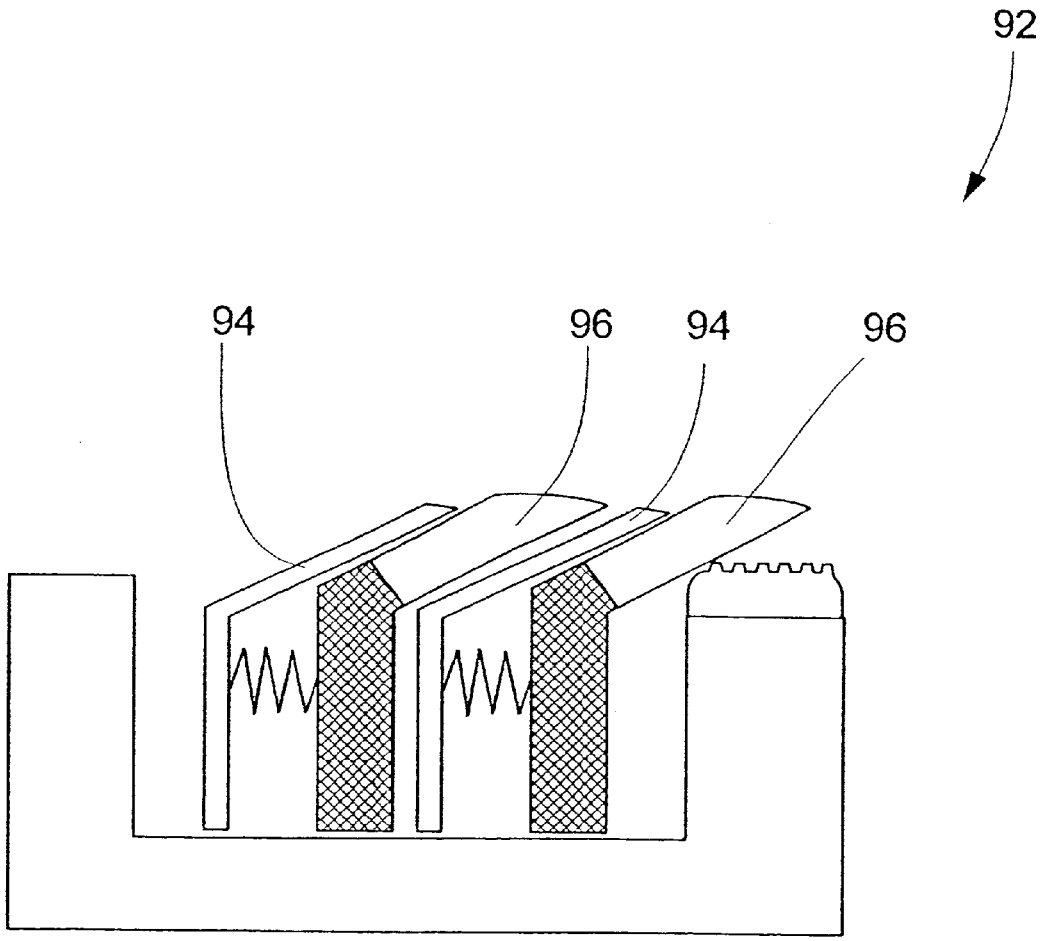
FIG. 8 is a schematic cross-sectional view through an alternative blade cartridge showing an adaptation of the spacer elements of FIG. 3 for use with a different blade configuration.
Figure 9:
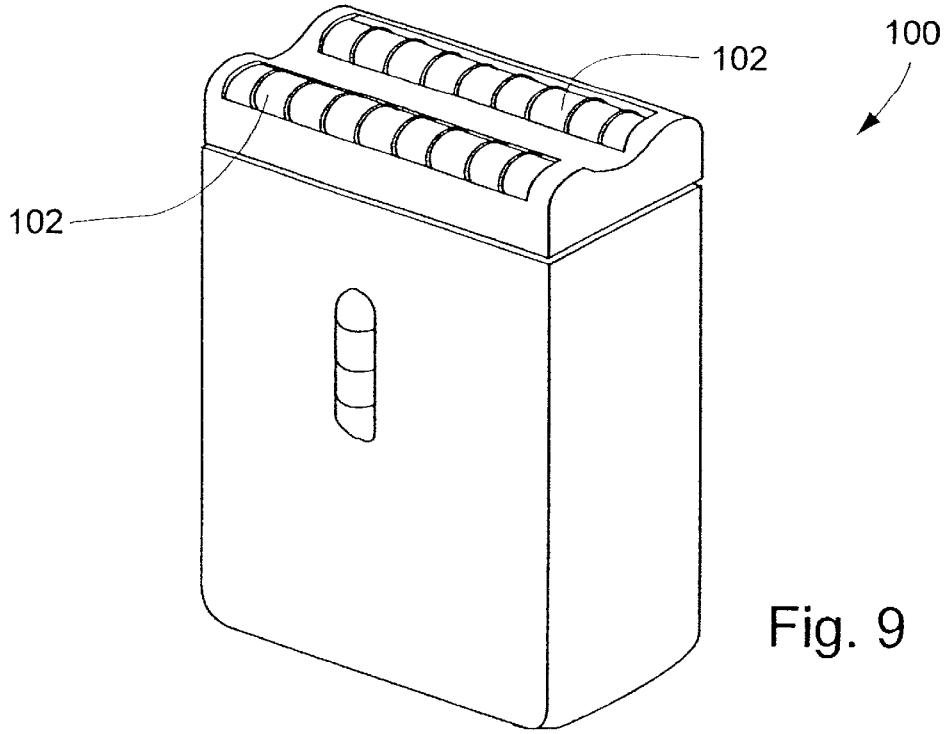
FIG. 9 is a schematic, isometric view of a further embodiment of an electric razor, constructed and operative according to the teachings of the present invention, having a pair of rotating blade assemblies.
Figure 10:
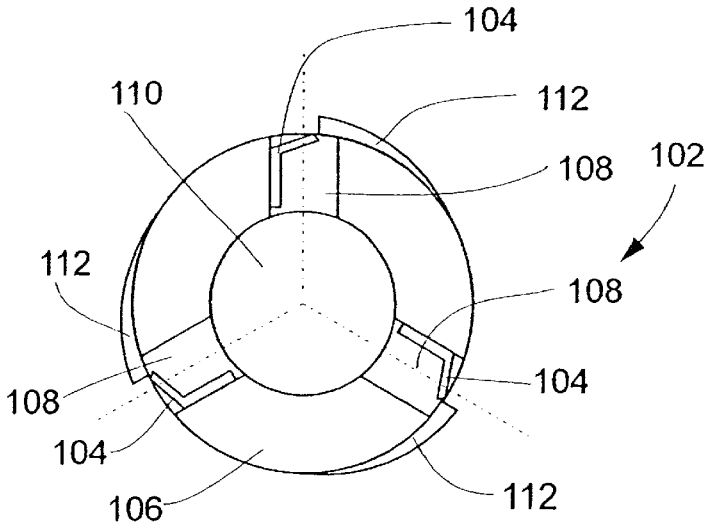
FIG. 10 is a transverse cross-section through a rotating blade assembly of the razor of FIG. 9.

Referring now briefly to FIG. 8, it should be appreciated that the present invention is not limited to any specific shape of blade. By way of example, there is shown an alternative form of a blade cartridge 92 having angled blades 94. Spacer elements 96, functionally equivalent to spacer elements 36 described above, are adapted to match the shape of the blades.

Turning now to FIGS. 9–12, a further embodiment of an electric razor 100 according to the present invention will now be described. Razor 100 is generally similar to razor 10 described above, differing primarily in the structure of its rotating blade assembly 102. Rotating blade assembly 102 is shown in more detail in FIGS. 10, 11A and 11B.

Rotating blade assembly 102 features a number of blades 104 which are attached in fixed relation within a roller 106. As mentioned earlier, fixed blades moving in a circular path have a relatively short contact travel with the surface of the skin on each revolution. None the less, given a sufficient rate of rotation, and especially with the use of a number of blades 104 angularly-spaced around the axis of roller 106, excellent results are obtained. Preferably, at least two, and typically three or more, blades are used.

Preferably, roller 106 is formed with radial channels 108 adjacent to each blade 104 which open into a central hollow 110. This provides an structure which can easily be cleaned by flushing out with water after use. The alignment of the blades is preferably achieved by a pair of alignment rings 114, attached to, or integrally formed with, the axle at either end of roller 106, which encompass the structure at each end. For clarity of presentation, one of alignment rings 114 has been omitted from FIG. 11A.

Also illustrated here is a preferred implementation of a safety blade configuration employing skin guide ridges 112. This safety blade configuration is relevant both to the roller construction illustrated here and to other exposedblade razor designs, including an otherwise conventional manual razor of fixed or removable cartridge design. A number of skin guide ridges 112 are positioned ahead of, and substantially adjacent to, the cutting edge of blade 104. The ridges lie above the cutting plane and are spaced along the cutting edge so as to prevent the blade from cutting the skin.

Skin guide ridges 112 are described as being positioned "ahead of", and "substantially adjacent to", the cutting edge of blade 104. "Ahead of" in this context is best defined with reference to a plane perpendicular to the cutting direction which passes through the cutting edge. All positions on the side of this plane away from the body of the blade are referred to as "ahead of" the cutting edge.

With regard to the degree of adjacency required, any configuration of ridges which extends sufficiently close to the cutting edge to maintain a safe but effective alignment of the blade relative to the skin of a user is described herein as "substantially adjacent". In practice the spacing between the ridges and the cutting edge is preferably no more than a few millimeters and typically much smaller. There is no lower limit to the desired spacing such that the ridges and the cutting edge may be in direct contact.

In this implementation, skin guide ridges 112 are projections mounted on, or integrally formed with, the outer surface of roller 106 which serves as a lead surface ahead of the cutting edge. In this case, the lead surface near the cutting edge is generally no higher than the cutting plane except for ridges 112 themselves. For a roller, the lead surface preferably corresponds to the surface swept through by the cutting edge as the roller rotates about its axis. The tangential plane to this surface adjacent to the blade would itself correspond substantially to the cutting plane. In a manual razor, at least part of the leading surface is preferably substantially coplanar with the cutting plane.

Figure 11A:
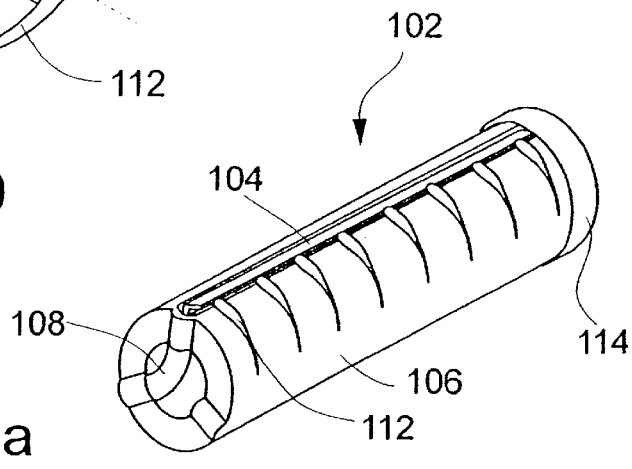
FIG. 11A is an isometric view of the rotating blade assembly of FIG. 10.
Figure 11B:
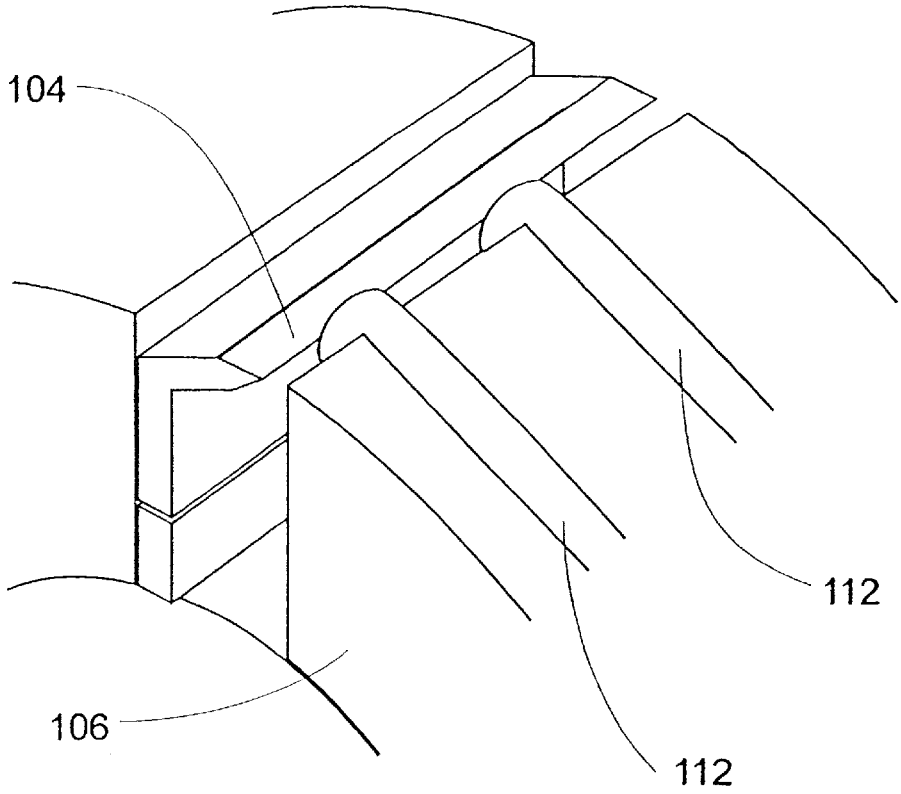
FIG. 11B is an enlargement of part of FIG. 11A showing the arrangement of guide ridges.
Figure 12:
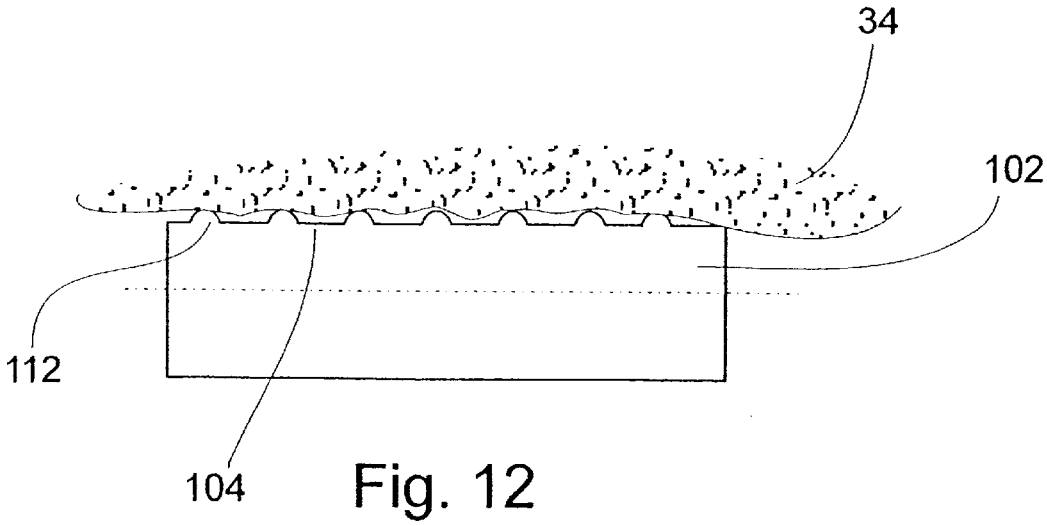
FIG. 12 is a schematic side view of the rotating blade assembly of FIG. 10 in contact with the skin of a user.

FIG. 11B shows more clearly the spatial relationship between guide ridges 112 and blade 104. As shown in FIG. 12, guide ridges 112 serve to lift small spaced-apart regions of the skin above the cutting plane of the blade so as to ensure that the intermediate parts of blade between the guide ridges make only tangential surface contact with the skin. Preferably, in order to ensure even shaving, the guide ridges in front of one blade are axially displaced relative to those of at least one other blade. Guide ridges 112 are provided at least in front of each blade and may extend around a major part of roller 106 in a manner similar to ridges 78 described above.

Figure 13A:
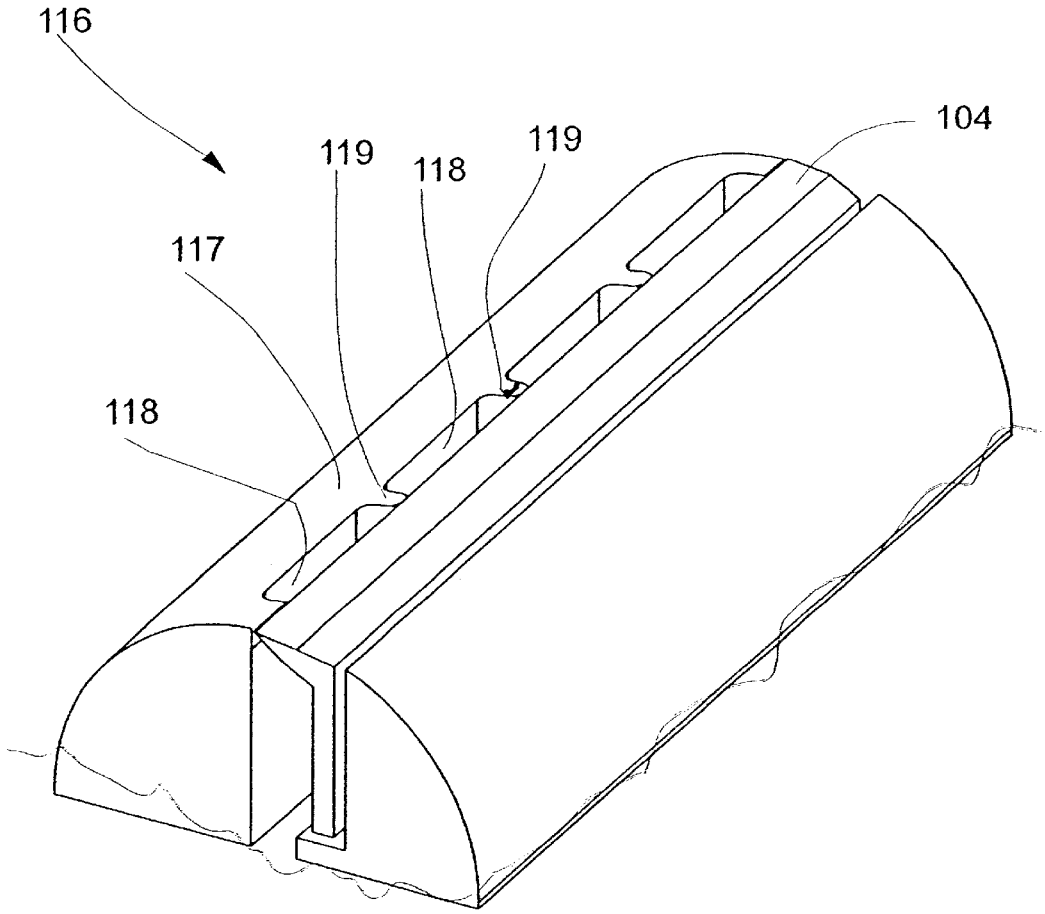
FIG. 13A is an isometric view of an alternative rotating blade assembly structure for use in the razor of FIG. 9.
Figure 13B:
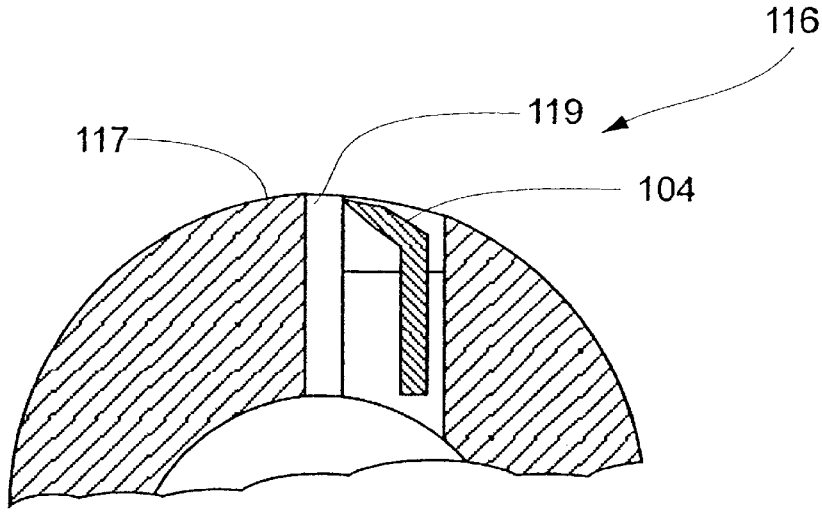
FIG. 13B is a transverse cross-section through the rotating blade assembly of FIG. 13A.

Turning now to FIGS. 13A and 13B, there is shown an alternative implementation of a safety blade assembly 116 conceptually similar to that of FIGS. 9–12. In this case, at least a part of a lead surface 117 provided by the roller or cartridge ahead of the cutting edge is substantially parallel to, but above, the cutting plane. The end portion of lead surface 117 nearest to the cutting edge is formed with a plurality of recesses 118 configured to allow the skin of the user to approach the cutting edge. Skin guide ridges 119 are implemented as continuations of lead surface 117 between recesses 118.

In both of the implementations described with reference to FIGS. 1–13, it will be apparent that the effectiveness of the safety configuration and the closeness of the shave may be adjusted by varying the different parameters defining the cutting geometry. By way of example, typical ranges for some of the parameters are as follows: the height of the skin guide ridges above the cutting plane is typically between about 0.05 and about 1 mm; the spacing between adjacent ridges measured along the cutting edge is typically between about 3 and about 15 mm; and the spacing between the ridges and the cutting edge is typically less than about 1 mm.

Figure 14:
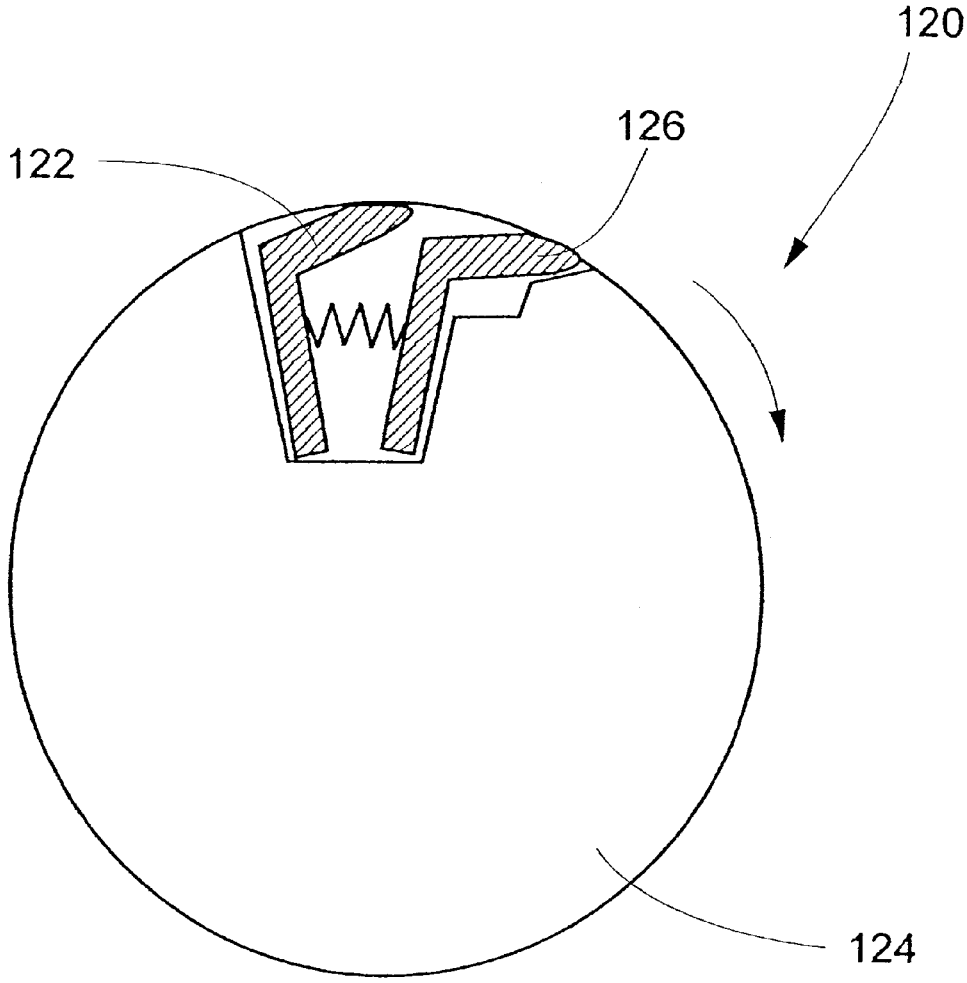
FIG. 14 is a transverse cross-section through another alternative rotating blade assembly for use in the razor of FIG. 9.

Finally, FIG. 14 shows an alternative rotating blade assembly 120 in which one or more blade 122 is directly attached to a roller 124. Here, guide ridges 112 have been replaced by a spacer 126 equivalent to spacer 96 of FIG. 8 described above. In other respects, rotating blade assembly 120 is typically similar to rotating blade assembly 102 already described.

It will be appreciated that the above descriptions are intended only to serve as examples, and that many other embodiments are possible within the spirit and the scope of the present invention.

What is claimed is:

1. A razor for cutting hair from the skin of a user, the razor comprising:

(a) a drive mechanism; and (b) a rotating blade assembly connected so as to be rotated by said drive mechanism, said blade assembly including:

(i) at least one roller having a longitudinal axis, said roller being mounted so as to be rotatable about said longitudinal axis, (ii) at least one safety blade cartridge removably attached to, and rotatable with, said roller, wherein said at least one safety blade cartridge includes a blade configuration with at least one exposed blade configured to operate without use of a cooperating blade, said at least one safety blade cartridge being configured for moving with said exposed blade in direct contact with the skin of the user so as to cut hair from the skin without cutting into the skin.

2. The razor of claim 1, wherein said at least one rotating blade assembly is implemented as two rotating blade assemblies, each of said blade assemblies having an exposed region defining at least one moving skin contact surface, wherein said rotating blade assemblies are associated with said drive mechanism so as to be driven in opposite directions such that said skin contact surfaces of said two rotating blade assemblies move outwards so as to tend to stretch the skin of the user between said rotating blade assemblies.

3. The razor of claim 1, wherein said blade cartridge is attached to said roller such that at least a part of said blade cartridge is displaceable so as to vary a distance of the blade from said longitudinal axis.

4. The razor of claim 3, wherein said blade cartridge is pivotally connected to said roller, said blade cartridge being biased to a raised position.

5. The razor of claim 3, wherein said blade cartridge is connected to said roller in a double-hinge manner, said blade cartridge being biased to a raised position.

6. The razor of claim 1, wherein said blade cartridge is a double-blade cartridge.

7. The razor of claim 1, further comprising a pneumatic cleaning mechanism mounted within said rotating blade assembly, said pneumatic cleaning mechanism being configured so as to direct a flow of air adjacent to the blade.

8. The razor of claim 1, wherein said pneumatic cleaning mechanism is mechanically linked so as to be actuated by displacement of said blade cartridge.

9. The razor of claim 1, further comprising a guide element mounted within said blade cartridge, wherein said guide element is implemented as a spacer adjacent to, and extending parallel to a length of, said blade, said spacer providing projections spaced along the length of said blade, said projections projecting outwards to above a cutting plane so as to prevent said blade from cutting the skin.

10. The razor of claim 9, wherein said spacer is displaceable relative to the blade, said spacer being biased from a rear guide position towards a forward position such that said spacer tends to eject any material accumulated in front of the blade during shaving, said spacer becoming depressed to said rear guide position on contact with the skin.

11. The razor of claim 1, further comprising an oscillator mechanism configured so as to produce a reciprocating movement of said at least one exposed blade parallel to said longitudinal axis during rotation of said blade assembly.

12. The razor of claim 11, wherein said oscillator mechanism is switchable between an operative state in which said oscillator mechanism is active to generate said reciprocating movement of said blade and an inoperative state in which said oscillator mechanism is deactivated.

13. The razor of claim 1, wherein said exposed blade has an elongated cutting edge configured for cutting in a cutting direction, a virtual plane passing through said cutting edge parallel to said cutting direction being referred to as a cutting plane, said safety blade cartridge further including a plurality of skin guide ridges located ahead of, and substantially adjacent to, said cutting edge, said skin guide ridges being deployed above said cutting plane and spaced along said cutting edge so as to prevent said exposed blade from cutting the skin.

* * * * *